US008119320B2

(12) United States Patent
Shinohara et al.

(10) Patent No.: US 8,119,320 B2
(45) Date of Patent: Feb. 21, 2012

(54) HEAT-SENSITIVE TRANSFER IMAGE-RECEIVING SHEET

(75) Inventors: Ryuji Shinohara, Minami-ashigara (JP); Yasuhisa Sano, Minami-ashigara (JP); Kazuma Takeno, Ashigarakami-gun (JP); Hiroshi Takehara, Fujinomiya (JP)

(73) Assignee: Fujifilm Corporation, Tokyo (JP)

( * ) Notice: Subject to any disclaimer, the term of this patent is extended or adjusted under 35 U.S.C. 154(b) by 220 days.

(21) Appl. No.: 12/057,157

(22) Filed: Mar. 27, 2008

(65) Prior Publication Data

US 2008/0241731 A1 Oct. 2, 2008

(30) Foreign Application Priority Data

Mar. 28, 2007 (JP) ..... 2007-085493

(51) Int. Cl.
*G03C 8/00* (2006.01)
*B65D 30/00* (2006.01)

(52) U.S. Cl. ..... 430/200; 428/32.5; 428/32.62; 428/32.72

(58) Field of Classification Search ..... 430/200; 428/32.5, 32.62, 32.72; 206/578, 397
See application file for complete search history.

(56) References Cited

U.S. PATENT DOCUMENTS

| | | | | |
|---|---|---|---|---|
| 4,755,432 | A * | 7/1988 | Asano et al. | 428/32.8 |
| 5,071,823 | A * | 12/1991 | Matsushita et al. | 503/227 |
| 6,501,496 | B1 * | 12/2002 | Kawabata | 347/171 |
| 6,913,876 | B2 * | 7/2005 | Kobayashi | 430/523 |
| 7,485,402 | B2 * | 2/2009 | Arai et al. | 430/201 |
| 2003/0117481 | A1 * | 6/2003 | Kometani et al. | 347/213 |
| 2005/0026779 | A1 | 2/2005 | Omata et al. | |
| 2007/0212636 | A1 * | 9/2007 | Shinohara et al. | 430/200 |
| 2009/0023103 | A1 * | 1/2009 | Toda | 430/619 |

FOREIGN PATENT DOCUMENTS

| | | | |
|---|---|---|---|
| EP | 0 634 288 | A1 | 1/1995 |
| EP | 0 714 787 | A2 | 6/1996 |
| EP | 0 791 952 | A2 | 8/1997 |
| JP | 06-115268 | A | 4/1994 |
| JP | 06-171240 | A | 6/1994 |
| JP | 06-227159 | A | 8/1994 |
| JP | 11-058993 | A | 3/1999 |
| JP | 11-105919 | * | 4/1999 |
| JP | 2000-141890 | | 5/2000 |
| JP | 2000-141890 | A | 5/2000 |
| JP | 2004-345267 | A | 12/2004 |
| JP | 2007-055254 | A | 3/2007 |

* cited by examiner

*Primary Examiner* — Thorl Chea

(74) *Attorney, Agent, or Firm* — Sughrue Mion, PLLC

(57) ABSTRACT

A heat-sensitive transfer image-receiving sheet, in which the heat-sensitive transfer image-receiving sheet is provided in a form that it is wound into a roll and all periphery of the roll is covered with a protective sheet, and in which the heat-sensitive transfer image-receiving sheet contains, on a support, at least one receptor layer containing a latex polymer, and at least one heat-insulating layer containing hollow polymer particles.

17 Claims, No Drawings

HEAT-SENSITIVE TRANSFER IMAGE-RECEIVING SHEET

FIELD OF THE INVENTION

The present invention relates to a heat-sensitive transfer image-receiving sheet (thermal transfer image-receiving sheet).

BACKGROUND OF THE INVENTION

Various heat transfer recording methods have been known so far. Among these methods, dye diffusion transfer recording systems attract attention as a process that can produce a color hard copy having an image quality closest to that of silver halide photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver halide photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

The image-receiving sheet for such a system is produced by coating, on a support, a dye-receptive layer and, when required, a layer having other functions, such as an intermediate layer. These layers may be produced by using solvent-based coating solutions or aqueous coating solutions.

After coating and drying of each of those layers, the image-receiving sheet is processed into the form of sheets or rolls according to specifications of a printer to be used. Then, the sheets or rolls are stored in appropriate packaging. The form of each packaging has no particular limitation, and one example thereof is the form of sack (case, pouch). As the material of each packaging, paper, plastic film or the like may be used. The thus packaged image-receiving sheets or rolls are transported and stored as they are or in a state that they are further contained in an appropriate casing, such as a corrugated-cardboard box.

A main purpose of packaging the image-receiving sheet is to prevent the sheet from deterioration of performance due to long-term storage. When there occur changes in performances such as sensitivity or transport ability for image-receiving sheets in a printer used, high-quality printed images cannot be obtained consistently. In fact, however, there are cases where it is difficult to keep the properties of image-receiving sheets stable for a long time. The long-term stability for the performance varies with properties of image-receiving sheets in themselves and manners of packaging. In particular, the long-term stability for the performance in the case of producing products obtained by using aqueous coating solution into the form of rolls and packaging them is inferior to that in other cases.

It is disclosed that changes in sensitivities of an ink sheet and an image-receiving sheet for use in a laser thermal transfer recording system can be suppressed by use of various packagings (e.g., JP-A-2000-141890 ("JP-A" means unexamined published Japanese patent application)). However, as a result of our examinations on thermal transfer systems, it has been found that there arises a new problem of causing changes in maximum transfer density. This problem arises only when image formation is carried out using an image-receiving sheet produced by using aqueous coating solutions, in which the sheet is processed into the form of rolls and packaged, and using a thermal head, not laser.

SUMMARY OF THE INVENTION

The present invention resides in a heat-sensitive transfer image-receiving sheet, in which the heat-sensitive transfer image-receiving sheet is provided in a form that it is wound into a roll and all periphery of the roll is covered with a protective sheet, and in which the heat-sensitive transfer image-receiving sheet contains, on a support, at least one receptor layer containing a latex polymer, and at least one heat-insulation layer containing hollow polymer particles.

Other and further features and advantages of the invention will appear more fully from the following description.

DETAILED DESCRIPTION OF THE INVENTION

According to the present invention, there is provided the following means:

(1) A heat-sensitive transfer image-receiving sheet:

wherein the heat-sensitive transfer image-receiving sheet is provided in a form that it is wound into a roll and all periphery of the roll is covered with a protective sheet, and wherein the heat-sensitive transfer image-receiving sheet comprises, on a support, at least one receptor layer containing a latex polymer, and at least one heat-insulation layer containing hollow polymer particles;

(2) The heat-sensitive transfer image-receiving sheet as described in the above item (1), wherein the protective sheet is moistureproof;

(3) The heat-sensitive transfer image-receiving sheet as described in the above item (1) or (2), which contains a water-soluble polymer;

(4) The heat-sensitive transfer image-receiving sheet as described in any one of the above items (1) to (3), which is produced by a simultaneous multilayer coating; and (5) The heat-sensitive transfer image-receiving sheet as described in any one of the above items (1) to (4), wherein the latex polymer in the receptor layer is any one selected from the group consisting of a vinyl chloride/acrylic compound latex copolymer, a vinyl chloride/vinyl acetate latex copolymer, a vinyl chloride/vinyl acetate/acrylic compound latex copolymer, and any combination of these.

Hereinafter, the present invention will be described in detail.

The heat-sensitive transfer image-receiving sheet of the present invention is a heat-sensitive transfer image-receiving sheet which is wound into a roll and provided in a form that all periphery of the sheet wound into a roll is covered with a protective sheet, and besides, the heat-sensitive transfer image-receiving sheet has, on a support, at least one receptor layer containing a latex polymer and at least one heat-insulation layer containing hollow polymer particles. We have found that consistent image formation suppressed in maximum transfer density changes can be attained by use of the heat-sensitive transfer image-receiving sheet as specified above. In the process of such a finding, it is found that the present heat-sensitive transfer image-receiving sheet had a surprising effect of being resistant to causing peel-off lines. On the basis of these findings, the present invention has come to be made.

These heat-sensitive transfer image-receiving sheets are each produced by the steps of preparing coating solutions, applying the coating solutions to a support and drying them. The image-receiving sheets in which the number of constituent layers of either or both of their individual receptor layer and heat-insulation layer is two or more are also preferred embodiments of the present invention. In the present invention, at least the heat-insulation layer and a constituent layer adjacent thereto on the receptor layer side are preferably formed by simultaneous multilayer coating. The constituent layer on the receptor layer side may be either a receptor layer or an intermediate layer having another function.

Each of steps in the production process is described below in detail.

(Preparation of Coating Solutions)

For preparing coating solutions finally having liquid properties responsive to desired quality by measuring and mixing ingredients, known methods and apparatus can be utilized. Examples of a measurement method usable herein include a method of measuring weight and a method of measuring volume. Examples of an agitator usable for mixing include a propeller stirrer and a jet agitator.

At the occasion of adding gelatin, it is also possible to adopt a method in which gelatin powder is dispersed in and impregnated with room-temperature water, the resulting swollen gelatin is made to dissolve by a temperature rise, and then added.

(Coating)

Coating of each layer can be preferably performed using a method chosen appropriately from the methods allowing simultaneous multilayer coating among known methods including roll coating, bar coating, gravure coating, gravure reverse coating, die coating, slide coating and curtain coating methods. Of these known methods, the curtain coating and slide coating methods are methods in which the thickness of coating film is determined by the flow rate of liquid dispensed by a pump or the like, and allow simultaneous multilayer coating.

It is known that in the case of producing an image-receiving sheet composed of plural layers having different functions from each other (for example, an air cell layer, a heat insulation layer, an intermediate layer and a receptor layer) on a support, it may be produced by applying each layer successively one by one, or by overlapping the layers each already coated on a support or substrate, as shown in, for example, JP-A-2004-106283, JP-A-2004-181888 and JP-A-2004-345267. It has been known in photographic industries, on the other hand, that productivity can be greatly improved, for example, by providing plural layers through simultaneous multi-layer coating. For example, there are known methods such as the so-called slide coating (slide coating method) and curtain coating (curtain coating method) as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050 ("JP-B" means examined Japanese patent publication); and Edgar B. Gutoff, et al., "Coating and Drying Defects: Troubleshooting Operating Problems", John Wiley & Sons Company, 1995, pp. 101-103. According to these coating methods, two or more kinds of coating solutions are fed simultaneously into a coater and formed into two or more different layers. These methods can be preferably applied to the present invention because they can deliver coating uniform in thickness and allow simultaneous multilayer coating.

As an example of apparatus for the slide coating method, there is the multilayer slide bead coater proposed by Russell et al. in U.S. Pat. No.2,761,791. Examples of the shape of the coater are also described in Stephen F. Kistler & Petert M. Schweizer, "Liquid Film Coating", Chapman & Hall (1997).

The slide bead coater is mainly composed of a coating head and a backup roller which supports a support continuously moving as it is winding about the backup roll. Into the interior of a coating head-forming block are provided liquid pools which diffusively shed their individual coating solutions dispensed from liquid feed lines in the width direction of the support, and narrow slits connected with these liquid pools are formed in an opened state so as to reach a slide surface. This slide surface is formed on the top side of the coating head, and inclined downward the backup roller side.

The coating solutions fed into their respective liquid pools are pressed out of their individual slits onto the slide surface, successively superposed upon one another as they are running down on the slide surface, thereby forming a multilayer coating, and reach to the tip of the lower end of the slide surface, on the whole, without mixing much with one another. The coating solutions arriving at the tip form their beads in the gap between the tip and the surface of a support moving continuously as it is winding about the backup roll, and applied to the substrate support via these coating solution beads. For the purpose of stabilizing the beads, the pressure imposed on the lower part is reduced. Therefore, a decompression chamber is formed at the lower place of the backup roller. This decompression chamber forms a negative pressure on the lower side of the beads, and the negative pressure functions so as to not only stabilize the beads but also allow easy running-down of excess coating solutions, which remain without applied to web, into the decompression chamber.

The curtain coating is a method of coating a freely falling liquid film on a support continuously running underneath the liquid film at a constant speed. This method has some coating systems including an extrusion system and a slide system. In the slide coater, a multilayer liquid film formed on a slide surface falls freely from the slide end. Therefore, the shape of the terminal of the slide surface is devised so as to smoothly form a falling liquid film.

In the simultaneous multilayer coating, it is required that the viscosity and surface tension of a coating solution to form each layer be adjusted so that formation of homogeneous coating film and satisfactory coating properties are achieved. The viscosity of each coating solution can be easily adjusted by using known thickeners or viscosity-depressants. And the surface tension of each coating solution can be adjusted by addition of various surfactants.

In feeding into a coating section each coating solution prepared so as to have appropriate values of physical properties including concentration, viscosity, surface tension and pH, it is required that the coating solution is continuously fed as foams and extraneous matter are eliminated.

Although various methods allow continuous feeding of each coating solution at a constant flow rate, it is preferable to use a metering pump in terms of accuracy and reliability. Examples of the metering pump include a plunger pump and a diaphragm type pump. In the diaphragm type pump, a plunger and a liquid to be fed are placed in isolation by means of two diaphragms, and the motion of the plunger is transmitted by way of a driving oil and pure water between the two diaphragms to the liquid to be fed. Changes in the flow rate of a liquid-feeding pump are linked with changes in the coating film thickness, so sufficient accuracy is required for the flow rate.

When it is required to reduce influences of pulsation of a pump, an auxiliary device for absorbing pulsation is used. Some systems for the auxiliary device are known, and one example thereof is a pulsation-absorbing device of pipeline type (JP-A-1-255793).

For elimination of extraneous matter, it is preferable to filter coating solutions. Various materials can be used as filtering media, and one example thereof is a cartridge filter. Prior to being used, filtering media preferably undergo treatment for prevention of mixing of air held in pores of the filtering media into coating solutions in the form of air bubbles. To such preventive treatment, several known methods are applicable. As an example thereof, mention may be made of pretreatment with a liquid containing a surfactant (U.S. Pat. No. 5,096,602).

Similarly to extraneous matter, air bubbles also become a cause of defects in coated surface conditions. Therefore, it is preferable that air bubbles mixed into coating solutions and foams floating on the solution surface are eliminated by defoaming and antifoaming treatment. As techniques for such treatment, there are separation of air bubbles from solutions and dissolution of air bubbles into solutions. Examples of a known technique for the separation include reduced-pressure defoaming, ultrasonic defoaming and centrifugal defoaming. And an example of a known technique for dissolution into solutions is ultrasonic pipeline defoaming.

In the case of using additives which degrade stability with lapse of time of a coating solution to which they are added, it is known to adopt a system that the additives are added right before the coating solution is fed into a coating section, during the liquid-feeding process, for the purpose of reducing a time lapsed from the addition to the coating. This system can be utilized in the present invention too. Examples of a mixer usable therein include a static mixer and a dynamic mixer.

(Drying)

After coating, a coated product having a coating film formed on a support is dried in a drying zone, made to pass through a humidity conditioning zone, and then wound into a roll. In the present invention, it is preferable that a multilayer coating film on a support is solidified immediately after the formation thereof. When the coating film is exposed to a strong drying wind while it is still in an insufficiently-solidified state, wave motion is caused and unevenness shows up. In addition, when an organic solvent is contained in the outermost layer of the coating film, the wind causes nonuniform evaporation of the organic solvent on the slide surface and immediately after coating to result in occurrence of unevenness. From this point of view, it is advantageous to adopt aqueous coating solutions.

In another case where a binder capable of gelling at low temperatures, such as gelatin, is contained in coating solutions, it is preferable that the coating film is subjected to cooling solidification through quick decrease in temperature immediately after multiple layers are formed on a support (set process), and then drying is performed under raised temperatures. By doing so, more uniform and more homogenous coating film can be formed.

The term "set process" as used herein means a gelling promotion process in which the viscosity of a coating film composition is increased by decreasing the temperature, e.g., through exposure of the coating film to a cold wind; as a result, inter-layer mobility and intra-layer mobility of ingredients are declined.

Since latex is a main constituent of coating solutions in the present invention, the coating film causes uneven shrinkage when it is quickly dried, and thereby cracks tend to develop in the dried coating film. Therefore, slow drying is preferred in the present invention. In order to satisfy such a requirement, it is required that the drying temperature and the volume and dew point of drying wind be adjusted appropriately and drying be performed while controlling the drying speed.

Typical drying devices include an air-loop system and a helical system. The air-loop system is a system in which drying blasts are made to blow on a coated product supported by rollers, and wherein a duct may be mounted either longitudinally or transversely. Such a system has a high degree of flexibility in setting of the volume of drying wind, because a drying function and a transporting function are basically separated therein. However, many rollers are used therein, so base-transporting failures, such as gathering, wrinkling and slipping, tend to occur. The helical system is a system in which a coated product is wound round a cylindrical duct in a helical fashion, and transported and dried as it is floated by drying wind (air floating). So no support by rollers is basically required (JP-B-43-20438). In the present invention, these drying devices can be preferably used.

(Packaging Material)

The thus produced heat-sensitive transfer image-receiving sheet is processed into the form of sheets or rolls according to specifications of a printer to be used. Thereafter, these sheets or rolls are stored in an appropriate packaging, and transported. The form of each packaging has no particular limitation, but one example thereof is a form of sack (case, pouch). The sack can be made easily by heat sealing. The "protective sheet" in the present invention means the packaging.

Examples of a material for forming a packaging include paper, cellophane, polyvinyl chloride- or polyvinylidene chloride-coated cellophane, acetate, low-density polyethylene, high-density polyethylene, polypropylene, polyvinyl chloride, polyvinylidene chloride, polyester, polystyrene, nylon, polycarbonate, ethylene-vinyl acetate copolymer, aluminum-evaporated film, and a laminated product of aluminum foil and polyethylene film.

One of properties required for the packaging consists in having no influence upon the image-receiving sheet stored in the packaging. In this respect, it is preferable for the packaging to be free of additives including a plasticizer or to be low in content of additives.

The packaging materials used in the present invention is preferably moisture-proof, and it is preferably less pervious to water vapor. The moisture permeability of the packaging materials at a temperature of 25° C. and a relative humidity of 90% is preferably 200 $g/m^2 \cdot day$ or less, more preferably 150 $g/m^2 \cdot day$ or less, most preferably 100 $g/m^2 \cdot day$ or less, and generally 0 $g/m^2 \cdot day$ or more. Preferred examples of the material of the packaging include polyethylene, polypropylene, polyvinylidene chloride, butyl rubber and polyester. Of these materials, polyethylene, polypropylene and polyvinylidene chloride are particularly preferable.

The packaging surface on the storage side may be smooth, or microscopic asperities may be formed thereon. Formation of microscopic asperities is proposed as a method of avoiding close adherence of the packaging to the image-receiving sheet.

Hereinafter, the constitution of the heat-sensitive transfer image-receiving sheet of the present invention is explained below in detail.

(Receptor Layer)

The receptor layer performs functions of receiving dyes transferred from an ink sheet and retaining images formed by these dyes. In the heat-sensitive transfer image-receiving sheet of the present invention, the receptor layer contains the latex polymer.

Further, to the receptor layer, there may be added an ultraviolet absorbent, a releasing agent, a sliding agent, an antioxidant, an antiseptic, a surfactant, and other additives.

-Latex Polymer-

The latex polymer for use in the present invention is described below. In the heat-sensitive transfer image-receiving sheet of the present invention, the latex polymer for use in the receptor layer is a dispersion in which water-insoluble hydrophobic polymers are dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. The dispersed particles preferably have a mean average particle size (diameter) of about 1 to 50,000 nm, more preferably about 5 to 1,000 nm. The particle size distribution of the dispersed particles is not particularly limited, and the particles may have either wide particle-size distribution or monodispersed particle-size distribution.

The latex polymer may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer that can be used in the present invention is preferably −30° C. to 130° C., more preferably 0°C. to 120° C., further preferably 40° C. or more (preferably 40° C. to 120° C.), and further more preferably 70° C. or more (preferably 70° C. to 100° C.).

In a preferable embodiment of the present invention, latex polymers such as acrylic-series polymers, polyesters, rubbers (e.g., SBR resins), polyurethanes, polyvinyl chlorides, polyvinyl acetates, polyvinylidene chlorides, and polyolefins, are preferably used. These latex polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight. A polymer having an excessively small molecular weight imparts insufficient dynamic strength to a layer containing latex of the polymer, and a polymer having an excessively large molecular weight brings about poor filming ability, and therefore both cases are undesirable. Crosslinkable polymer latexes are also preferably used.

In synthesis of the latex polymer used in the present invention, there is no particular limitation to monomers to be used, in combination, and the following monomer groups (a) to (j) may be preferably used as those polymerizable in a usual radical polymerization or ion polymerization method. These monomers may be selected singly or combined freely to synthesize the latex polymer.

-Monomer Groups (a) to (j)- a) Conjugated dienes: 1,3-pentadiene, isoprene, 1-phenyl-1,3-butadiene, 1-α-naphthyl-1,3-butadiene, 1-β-naphthyl-1,3-butadiene, cyclopentadiene, etc.

(b) Olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, etc.

(c) α,β-unsaturated carboxylates: alkyl acrylates, such as methyl acrylate, ethyl acrylate, butyl acrylate, cyclohexyl acrylate, 2-ethylhexyl acrylate, and dodecyl acrylate; substituted alkyl acrylates, such as 2-chloroethyl acrylate, benzyl acrylate, and 2-cyanoethyl acrylate; alkyl methacrylates, such as methyl methacrylate, butyl methacrylate, 2-ethylhexyl methacrylate, and dodecyl methacrylate; substituted alkyl methacrylates, such as 2-hydroxyethyl methacrylate, glycidyl methacrylate, glycerin monomethacrylate, 2-acetoxyethyl methacrylate, tetrahydrofurfuryl methacrylate, 2-methoxyethyl methacrylate, polypropylene glycol monomethacrylates (mole number of added polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, and 2-isocyanatoethyl methacrylate; derivatives of unsaturated dicarboxylic acids, such as monobutyl maleate, dimethyl maleate, monomethyl itaconate, and dibutyl itaconate; multifunctional esters, such as ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, and 1,2,4-cyclohexane tetramethacrylate; etc.

(d) α,β-unsaturated carboxylic amides: acrylamide, methacrylamide, N-methylacrylamide, N,N-dimethylacrylamide, N-methyl-N-hydroxyethylmethacrylamide, N-tert-butylacrylamide, N-tert-octylmethacrylamide, N-cyclohexylacrylamide, N-phenylacrylamide, N-(2-acetoacetoxyethyl)acrylamide, N-acryloylmorpholine, diacetone acrylamide, itaconic diamide, N-methylmaleimide, 2-acrylamide-methylpropane sulfonic acid, methylenebisacrylamide, dimethacryloylpiperazine, etc.

(e) Unsaturated nitriles: acrylonitrile, methacrylonitrile, etc.

(f) Styrene and derivatives thereof: styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrenesulfinate, p-aminomethylstyrene, 1,4-divinylbenzene, etc.

(g) Vinyl ethers: methyl vinyl ether, butyl vinyl ether, methoxyethyl vinyl ether, etc.

(h) Vinyl esters: vinyl acetate, vinyl propionate, vinyl benzoate, vinyl salicylate, vinyl chloroacetate, etc.

(i) α,β-unsaturated carboxylic acids and salts thereof: acrylic acid, methacrylic acid, itaconic acid, maleic acid, sodium acrylate, ammonium methacrylate, potassium itaconate, etc.

(j) Other polymerizable monomers: N-vinylimidazole, 4-vinylpyridine, N-vinylpyrrolidone, 2-vinyloxazoline, 2-isopropenyloxazoline, divinylsulfone, etc.

The latex polymer that can be used in the present invention is also commercially available, and polymers described below may be utilized in combination.

Examples of the acrylic-series polymers include Cevian A-4635, 4718, and 4601 (trade names, manufactured by Daicel Chemical Industries); Nipol Lx811, 814, 821, 820, 855 (P-1 7: Tg 36° C.), and 857x2 (P-18: Tg 43° C.) (trade names, manufactured by Nippon Zeon Co., Ltd.); Voncoat R3370 (P-19: Tg 25° C.), and 4280 (P-20: Tg 15° C.) (trade names, manufactured by Dai-Nippon Ink & Chemicals, Inc.); Julimer ET-410 (P-21: Tg 44° C.) (trade name, manufactured by Nihon Junyaku K. K.); AE116 (P-22: Tg 50° C.), AE119 (P-23: Tg 55° C.), AE121 (P-24: Tg 58° C.), AE125 (P-25: Tg 60° C.), AE134 (P-26: Tg 48° C.), AE137 (P-27: Tg 48° C.), AE140 (P-28: Tg 53° C.), and AE173 (P-29: Tg 60° C.) (trade names, manufactured by J S R Corporation); Aron A-104 (P-30: Tg 45° C.) (trade name, manufactured by Toagosei Co., Ltd.); NS-600X, and NS-620X (trade names, manufactured by Takamatsu Yushi K. K.); VINYBLAN 2580, 2583, 2641, 2770, 2770H, 2635, 2886, 5202C, and 2706 (trade names, manufactured by Nissin Chemical Industry Co., Ltd.).

Examples of the polyesters include FINETEX ES650, 611, 675, and 850 (trade names, manufactured by Dainippon Ink and Chemicals, Incorporated); WD-size, and WMS (trade names, manufactured by Eastman Chemical Ltd.); A- 110, A-115GE, A-120, A-21, A-124GP, A-124S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-252G, S-250S, S-320, S-680, DNS-63P, NS-122L, NS-122LX, NS-244LX, NS-140L, NS-141LX, and NS-282LX (trade names, manufactured by Takamatsu Yushi K. K.); Aronmelt PES-1000 series, and PES-2000 series (trade names, manufactured by Toagosei Co., Ltd.); Bironal MD-1100, MD-1200, MD-1220, MD-1245, MD-1250, MD-1335, MD-1400, MD-1480, MD-1500, MD-1930, and MD-1985 (trade names, manufactured by Toyobo Co., Ltd.); and Ceporjon ES (trade name, manufactured by Sumitomo Seika Chemicals Co., Ltd.).

Examples of the polyurethanes include HYDRAN AP10, AP20, AP30, AP40, and 101H, Vondic 1320NS and 1610NS (trade names, manufactured by Dainippon Ink and Chemicals, Incorporated); D-1000, D-2000, D-6000, D-4000, and D-9000 (trade names, manufactured by Dainichi Seika Color & Chemicals Mfg. Co., Ltd.); NS-155X, NS-310A, NS-310X, and NS-311X (trade names, manufactured by Takamatsu Yushi K. K.); and Elastron (trade name, manufactured by Dai-ichi Kogyo Seiyaku Co., Ltd.).

Examples of the rubbers include LACSTAR 7310K, 3307B, 4700H, and 7132C (trade names, manufactured by Dainippon Ink & Chemicals Incorporated); and Nipol Lx416 , LX410, LX430, LX435, LX110, LX415A, LX438C, 2507H, LX303A, LX407BP series, V1004, and MH5055 (trade names, manufactured by Nippon Zeon Co., Ltd.).

Examples of the polyvinyl chlorides include G351 and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (trade names, manufactured by Nissin Chemical Industry Co., Ltd.).

Examples of the polyvinylidene chlorides include L502 and L513 (trade names, manufactured by Asahi Kasei Corporation); D-5071 (trade name, manufactured by Dai-Nippon Ink & Chemicals, Inc.).

Examples of the polyolefins include Chemipearl S120, SA200, and V300 (P-40: Tg 80° C.) (trade names, manufactured by Mitsui Petrochemical); Voncoat 2830, 2210, and 2960 (trade names, manufactured by Dainippon Ink and Chemicals, Incorporated); Zaikusen and Ceporjon G (trade names, manufactured by Sumitomo Seika Chemicals Co., Ltd.).

Examples of the copolymer nylons include Ceporjon PA (trade name, manufactured by Sumitomo Seika Chemicals Co., Ltd.).

Examples of the polyvinyl acetates include VINYBLAN 1080, 1082, 1085W, 1108W, 1108S, 1563M, 1566, 1570, 1588C, A22J7-F2, 1128C, 1137, 1138,A20J2, A23J1, A23J1, A23K1, A23P2E, A68J1N, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W, and 4468S (trade names, manufactured by Nisshin Chemical Industry Co., Ltd.).

These latex polymers may be used singly, or two or more of these polymers may be blended, if necessary. Preferred examples of the latex polymer used in the present invention include a vinyl chloride/acrylic compound latex copolymer, a vinyl chloride/vinyl acetate latex copolymer, a vinyl chloride/vinyl acetate/acrylic compound latex copolymer, and any combination of these. Of these, a vinyl chloride/acrylic compound latex copolymer is most preferable.

Herein, the latex polymer is preferably a latex polymer which has, on the one hand, high compatibility with dyes in order to accept dyes transferred from an ink sheet and, on the other, low compatibility with binders in which dyes of the ink sheet are dispersed. When a latex polymer highly compatible with dyes is used, the maximum transfer densities are enhanced and sharp images can be obtained. When a latex polymer highly compatible with binders in which dyes of an ink sheet are dispersed is used, peeling noises tend to be made when the ink sheet is superposed on the heat-sensitive transfer image-receiving sheet, heated and then peeled from each other. The higher compatible the latex polymer is, the lauder the peeling noises. And peel-off lines (banding) eventually develop when the ink sheet is peeled off.

In the present invention, at least one receptor layer is formed by application of an aqueous type coating solution. In producing the image-receiving sheet provided with two or more receptor layers, it is preferable that all the receptor layers are formed by application of aqueous type coating solutions, and then they are dried. The "aqueous type" so-called here means that 60% by mass or more of the solvent (dispersion medium) of the coating solution is water. As a component other than water in the coating solution, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The latex polymer that can be used in the present invention preferably has a minimum film-forming temperature (MFT) of from −30 to 90° C., more preferably from 0 to 70° C.

Preferable examples of the latex polymer for use in the present invention include polylactates, polyurethanes, polycarbonates, polyesters, polyacetals, SBR's, and polyvinyl chlorides. Among these, polyesters, polycarbonates, and polyvinyl chlorides are preferable.

In the present invention, the polyvinyl chlorides are preferred among the above-described latex polymer. Of these polyvinyl chlorides that are latex polymer containing a recurring unit obtained from vinyl chloride, preferred is latex polymer containing a recurring unit obtained from vinyl chloride in an amount of 50 mole % or more based on the latex polymer. Copolymerized latex polymer is more preferred. With respect to the copolymerized latex polymer, preferable monomers that polymerize with vinyl chloride are acrylic or methacrylic acid or esters thereof, vinyl acetate and ethylene, more preferably acrylic or methacrylic acid or esters thereof, and still more preferably acrylic acid esters. A copolymer of vinyl chlorides and acrylic and vinyl chloride-series is also preferable. The alcohol moiety that composes the ester group of the acrylic acid ester has preferably carbon atoms of from 1 to 10, and more preferably from 1 to 8.

Examples of the polyvinyl chloride include those described above. Among these, VINYBLAN 240, VINYBLAN 270, VINYBLAN 276, VINYBLAN 277, VINYBLAN 375, VINYBLAN 380, VINYBLAN 386, VINYBLAN 410, VINYBLAN 430, VINYBLAN 432, VINYBLAN 550, VINYBLAN 601, VINYBLAN 602, VINYBLAN 609, VINYBLAN 619, VINYBLAN 680, VINYBLAN 680S, VINYBLAN 681N, VINYBLAN 683, VINYBLAN 685R, VINYBLAN 690, VINYBLAN 860, VINYBLAN 863, VINYBLAN 865, VINYBLAN 867, VINYBLAN 900, VINYBLAN 938 and VINYBLAN 950 (trade names, manufactured by Nissin Chemical Industry Co., Ltd.); and SE1320, S-830 (trade names, manufactured by Sumica Chemtex) are preferable.

In the present invention, latex polymers are used for reception of dyes transferred from an ink sheet, and they may be used in combination with any other polymers.

Polymers with which the latex polymers are used in combination, though may be used for reception of dyes, can also be used as binders for keeping of the latex polymers.

Preferred polymers are transparent or semitransparent, and generally colorless. Examples include natural resins, polymers and copolymers; synthetic resins, polymers, and copolymers; and other media that form films: for example, gelatins, polyvinyl alcohols, hydroxyethyl celluloses, cellulose acetates, cellulose acetate butylates, polyvinylpyrrolidones, caseins, starches, polyacrylic acids, polymethyl methacrylates, polyvinyl chlorides, polymethacrylic acids, styrene/maleic acid anhydride copolymers, styrene/acrylonitrile copolymers, styrene/butadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, and polyamides. The binder may be dissolved or dispersed in a water or in an organic solvent, or may be in the form of an emulsion.

When, besides the latex polymer used for reception of dyes transferred from an ink sheet, the above-mentioned binder is used, the glass transition temperature (Tg) of the latex polymer is preferably in the range of −30° C. to 70° C., more preferably −10° C. to 50° C., still more preferably 0° C. to 40° C., in view of film-forming properties (brittleness for working) and image preservability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

The glass transition temperature (Tg) can be calculated according to the following equation:

$$1/Tg=\Sigma(Xi/Tgi)$$

wherein, assuming that the polymer is a copolymer composed of n monomer components from i=1 to i=n, Xi is a mass fraction of the i-th monomer ($\Sigma Xi=1$) and Tgi is glass transition temperature (measured in absolute temperature) of a homopolymer formed from the i-th monomer. The symbol Σ means the sum of i=1 to i=n. The value of the glass transition temperature of a homopolymer formed from each monomer (Tgi) is adopted from J. Brandrup and E. H. Immergut, "Polymer Handbook, 3rd. Edition", Wiley-Interscience (1989).

Incidentally, although the glass transition temperatures of the latex polymers used in the present invention for reception of dyes and those of hollow polymers as described hereinafter are defined by measured values, they can also be estimated from the above calculating formula.

<Water-Soluble Polymer>

In the present invention, the receptor layer preferably contains a water-soluble polymer.

Herein, the "water-soluble polymer" means a polymer which dissolves, in 100 g water at 20° C., in an amount of preferably 0.05 g or more, more preferably 0.1 g or more, further preferably 0.5 g or more, and particularly preferably 1 g or more. The latex polymer refers to the state in which polymer fine particles are dispersed in a dispersion medium, so it is different from the water-soluble polymers usable in the present invention.

The water-soluble polymer which can be used in the present invention is any of natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention.

In the present invention, the water-soluble polymer is also referred to as a binder, for differentiation from the latex polymer described above.

Among the water-soluble polymers which can be used in the present invention, the natural polymers and the semi-synthetic polymers will be explained in detail. Specific examples include the following polymers: plant type polysaccharides, such as gum arabics, κ-carrageenans, ι-carrageenans, γ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides, such as xanthan gums (e.g. Keltrol T, manufactured by Kelco) and dextrins (e.g. Nadex 360, manufactured by National Starch & Chemical Co.); animal type natural polymers, such as gelatins (e.g. Crodyne B419, manufactured by Croda), caseins, sodium chondroitin sulfates (e.g. Cromoist CS, manufactured by Croda); cellulose-based polymers, such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet, manufactured by Hercules), and cationated celluloses (e.g. Crodacel QM, manufactured by Croda); starches, such as phosphorylated starches (e.g. National 78-1898, manufactured by National Starch & Chemical Co.); alginic acid-based compounds, such as sodium alginates (e.g. Keltone, manufactured by Kelco) and propylene glycol alginates; and other polymers, such as cationated guar gums (e.g. Hi-care 1000, manufactured by Alcolac) and sodium hyaluronates (e.g. Hyalure, manufactured by Lifecare Biomedial) (all of the names are trade names).

Gelatin is one of preferable embodiments in the present invention. Gelatin having a molecular mass of from 10,000 to 1,000,000 may be used in the present invention. Gelatin that can be used in the present invention may contain an anion, such as $Cl^-$ and $SO_4^{2-}$, or alternatively a cation, such as $Fe^{2+}$, $Ca^{2+}$, $Mg^{2+}$, $Sn^{2+}$, and $Zn^{2+}$. Gelatin is preferably added as an aqueous solution.

Among the water-soluble polymers which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (e.g., Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.).

In addition, use may also be made of highly-water-absorptive polymers, namely, homopolymers of vinyl monomers having —COOM or —$SO_3$M (M represents a hydrogen atom or an alkali metal atom) or copolymers of these vinyl monomers among them or with other vinyl monomers (for example, sodium methacrylate, ammonium methacrylate, Sumikagel L-5H (trade name) manufactured by Sumitomo Chemical Co., Ltd.), as described in, for example, U.S. Pat. No. 4,960,681 and JP-A-62-245260.

Among the water-soluble synthetic polymers that can be used in the present invention, polyvinyl alcohols are preferable.

The polyvinyl alcohols are explained in detail below.

Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0±0.8 CPS]; PVA-117 [PVA content: 94.0 mass %; degree of saponification: 98.5±0.5 mol %; content of sodium acetate: 1.0 mass %; volatile constituent: 5.0 mass %; viscosity (4 mass %; 20° C.): 28.0±3.0 CPS]; PVA-117H [PVA content: 93.5 mass %; degree of saponification: 99.6±0.3 mol %; content of sodium acetate: 1.85 mass %; volatile constituent: 5.0 mass %; viscosity (4 mass %; 20° C.): 29.0±3.0 CPS]; PVA-120 [PVA content: 94.0 mass %; degree of saponification: 98.5±0.5 mol %; content of sodium acetate: 1.0 mass %; volatile constituent: 5.0 mass %; viscosity (4 mass %; 20° C.): 39.5±4.5 CPS]; PVA-124 [PVA content: 94.0 mass %; degree of saponification: 98.5±0.5 mol %; content of sodium acetate: 1.0 mass %; volatile constituent: 5.0 mass %; viscosity (4 mass %; 20° C.): 60.0±6.0 CPS]; PVA-124H [PVA content: 93.5 mass %; degree of saponification: 99.6±0.3 mol %; content of sodium acetate: 1.85 mass %; volatile constituent: 5.0 mass %; viscosity (4 mass %; 20° C.): 61.0±6.0 CPS]; PVA-CS [PVA content: 94.0 mass %; degree of saponification: 97.5±0.5 mol %; content of sodium acetate: 1.0 mass %; volatile constituent: 5.0 mass %; viscosity (4 mass %; 20° C.): 27.5±3.0 CPS]; PVA-CST [PVA content: 94.0 mass %; degree of saponification: 96.0±0.5 mol %; content of sodium acetate: 1.0 mass %; volatile constituent: 5.0 mass %; viscosity (4 mass %; 20° C.): 27.0±3.0 CPS]; and PVA-HC [PVA content: 90.0 mass %; degree of saponification: 99.85 mol % or more; content of sodium acetate: 2.5 mass %; volatile constituent: 8.5 mass %; viscosity (4 mass %; 20° C.): 25.0±3.5 CPS] (all trade names, manufactured by Kuraray Co., Ltd.), and the like.

Examples of partially saponificated polyvinyl alcohol include PVA-203 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.4±0.2 CPS]; PVA-204 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.9±0.3 CPS]; PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-210 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS]; PVA-224 [PVA content: 94.0 mass %; degree of saponification: 88.0±1.5 mol %; content of sodium acetate: 1.0 mass %; volatile constituent: 5.0 mass %; viscosity (4 mass %; 20° C.): 44.0±4.0 CPS]; PVA-228 [PVA content: 94.0 mass %; degree of saponification: 88.0±1.5 mol %; content of sodium acetate: 1.0 mass %; volatile constituent: 5.0 mass %; viscosity (4 mass %; 20° C.): 65.0±5.0 CPS]; PVA-235 [PVA content: 94.0 mass %; degree of saponification: 88.0±1.5 mol %; content of sodium acetate: 1.0 mass %; volatile constituent: 5.0 mass %; viscosity (4 mass %; 20° C.): 95.0±15.0 CPS]; PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS]; PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-403 [PVA content: 94.0 mass %; degree of saponification: 80.0±1.5 mol %; content of sodium acetate: 1.0 mass %; volatile constituent: 5.0 mass %; viscosity (4 mass %; 20° C.): 3.1±0.3 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS]; PVA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; L-8 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner according to JIS K-6726-1977.

With respect to modified polyvinyl alcohols, those described in Koichi Nagano, et al., "Poval", Kobunshi Kankokai, Inc. are useful. The modified polyvinyl alcohols include polyvinyl alcohols modified by cations, anions, —SH compounds, alkylthio compounds, or silanols.

Examples of such modified polyvinyl alcohols (modified PVA) include C polymers, such as C-118, C-318, C-318-2A, and C-506 (all being trade names of Kuraray Co., Ltd.); HL polymers, such as HL-12E and HL-1203 (all being trade names of Kuraray Co., Ltd.); HM polymers, such as HM-03 and HM-N-03 (all being trade names of Kuraray Co., Ltd.); K polymers, such as KL-118, KL-318, KL-506, KM-118T, and KM-618 (all being trade names of Kuraray Co., Ltd.); M polymers, such as M-115 (a trade name of Kuraray co., Ltd.); MP polymers, such as MP-102, MP-202, and MP-203 (all being trade names of Kuraray Co., Ltd.); MPK polymers, such as MPK-1, MPK-2, MPK-3, MPK-4, MPK-5, and MPK-6 (all being trade names of Kuraray Co., Ltd.); R polymers, such as R-1130, R-2105, and R-2130 (all being trade names of Kuraray Co., Ltd.); and V polymers, such as V-2250 (a trade name of Kuraray Co., Ltd.).

The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid to be added is preferably 0.01 to 40 mass %, with respect to polyvinyl alcohol.

In the present invention, preferred water-soluble polymers are polyvinyl alcohols and gelatin, with gelatin being most preferred.

The amount of the water-soluble polymer to be added to the receptor layer is preferably from 1 to 25% by mass, more preferably from 1 to 10% by mass, based on the entire mass of the receptor layer. Not using any water-soluble polymer is also a preferred embodiment of the present invention.

<Polymers Other Than the Water-soluble Polymer>

The polymer, except for the water-soluble polymer, for use as the binder in the present invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Also, a method is preferable in which the polymer is prepared in a solution, and the solution is neutralized, or an emulsifier is added to the solution, to which water is then added, to prepare an aqueous dispersion by forced stirring. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions, such as the dispersion medium, the monomer concentration, the amount of initiator, the amount of emulsifier, the amount of dispersant, the reaction temperature, and the method for adding monomers, are suitably determined considering the type of the monomers to be used. Furthermore, it is preferable to use a dispersant when necessary.

Generally, the emulsion polymerization method can be conducted according to the disclosures of the following documents: "Gosei Jushi Emarujon (Synthetic Resin Emulsions)" (edited by Taira Okuda and Hiroshi Inagaki and published by Kobunshi Kankokai (1978)); "Gosei Ratekkusu no Oyo (Applications of Synthetic Latexes)" (edited by Takaaki Sugimura, Yasuo Kataoka, Soichi Suzuki, and Keiji Kasahara and published by Kobunshi Kankokai (1993)); and "Gosei Ratekkusu no Kagaku (Chemistry of Synthetic Latexes)" (edited by Soichi Muroi and published by Kobunshi Kankokai (1970)). The emulsion polymerization method for synthesizing the latex polymer for use in the present invention may be a batch polymerization method, a monomer (continuous or divided) addition method, an emulsion addition method, or a seed polymerization method. The emulsion polymerization method is preferably a batch polymerization method, a monomer (continuous or divided) addition method, or an emulsion addition method in view of the productivity of latex.

The polymerization initiator may be any polymerization initiator having radical generating ability. The polymerization initiator to be used may be selected from inorganic peroxides, such as persulfates and hydrogen peroxide, peroxides as described in the organic peroxide catalogue of NOF Corporation, and azo compounds as described in the azo polymerization initiator catalogue of Wako Pure Chemical Industries, Ltd. Among them, water-soluble peroxides, such as persulfates, and water-soluble azo compounds as described in the azo polymerization initiator catalogue of Wako Pure Chemical Industries, Ltd. are preferable; ammonium persulfate, sodium persulfate, potassium persulfate, azobis(2-methylpropionamidine) hydrochloride, azobis(2-methyl-N-(2-hydroxyethyl)propionamide), and azobiscyanovaleric acid are more preferable; and peroxides, such as ammonium persulfate, sodium persulfate, and potassium persulfate, are especially preferable from the viewpoints of image preservability, solubility, and cost.

The amount of the polymerization initiator to be added is, based on the total amount of monomers, preferably 0.3 mass % to 2.0 mass %, more preferably 0.4 mass % to 1.75 mass %, and especially preferably 0.5 mass % to 1.5 mass %.

The polymerization emulsifier to be used may be selected from anionic surfactants, nonionic surfactants, cationic surfactants, and ampholytic surfactants. Among them, anionic surfactants are preferable from the viewpoints of dispersibility and image preservability. Sulfonic acid type anionic surfactants are more preferable because polymerization stability can be ensured even with a small addition amount and they have resistance to hydrolysis. Long chain alkyldiphenyl ether disulfonic acid salts (whose typical example is PELEX SS-H (trade name) manufactured by Kao Corporation,) are still more preferable, and low electrolyte types, such as PIONIN A-43-S (trade name, manufactured by Takemoto Oil & Fat Co., Ltd.) are especially preferable.

The amount of sulfonic acid type anionic surfactant as the polymerization emulsifier is preferably 0.1 mass % to 10.0 mass %, more preferably 0.2 mass % to 7.5 mass %, and especially preferably 0.3 mass % to 5.0 mass %, based on the total amount of monomers.

It is preferable to use a chelating agent in synthesizing the latex polymer to be used in the present invention. The chelating agent is a compound capable of coordinating (chelating) a polyvalent ion, such as metal ion (e.g., iron ion) or alkaline earth metal ion (e.g., calcium ion), and examples of the chelate compound which can be used include the compounds described in JP-B-6-8956, U.S. Pat. No.5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-114154, JP-A-7-120894, JP-A-7-199433, JP-A-7-306504, JP-A-9-43792, JP-A-8-314090, JP-A-10-182571, JP-A-10-182570, and JP-A-11-190892.

Preferred examples of the chelating agent include inorganic chelate compounds (e.g., sodium tripolyphosphate, sodium hexametaphosphate, sodium tetrapolyphosphate), aminopolycarboxylic acid-based chelate compounds (e.g., nitrilotriacetic acid, ethylenediaminetetraacetic acid), organic phosphonic acid-based chelate compounds (e.g., compounds described in Research Disclosure, No.18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, and West German Patent No. 1045373), polyphenol-based chelating agents, and polyamine-based chelate compounds, with aminopolycarboxylic acid derivatives being particularly preferred.

Preferred examples of the aminopolycarboxylic acid derivative include the compounds shown in the Table attached to "EDTA (-Complexane no Kagaku-) (EDTA-Chemistry of Complexane-)", Nankodo (1977). In these compounds, a part of the carboxyl groups may be substituted by an alkali metal salt, such as sodium or potassium or by an ammonium salt. More preferred examples of the aminopolycarboxylic acid derivative include iminodiacetic acid, N-methyliminodiacetic acid, N-(2-aminoethyl)iminodiacetic acid, N-(carbamoylmethyl)iminodiacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,1-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,1-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-α-propionic acid, ethylenediamine-N,N'-diacetic acid-N,N'-di-β-propionic acid, ethylenediamine-N,N,N',N'-tetrapropionic acid, diethylenetriamine-N,N,N',N",N"-pentaacetic acid, triethylenetetramine-N,N,N',N",N'",N'"-hexaacetic acid, and 1,2,3-triaminopropane-N,N,N',N",N'",N'"-hexaacetic acid. In these compounds, a part of the carboxyl groups may be substituted by an alkali metal salt, such as sodium or potassium or by an ammonium salt.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is too small, metal ions entering during the preparation of the latex polymer are not sufficiently trapped, and the stability of the latex against aggregation is lowered, whereby the coating properties become worse. When the amount is too large, the viscosity of the latex increases, whereby the coating properties deteriorate.

In the preparation of the latex polymer to be used in the present invention, it is preferable to use a chain transfer agent. As the chain transfer agent, ones described in Polymer Handbook (3rd Edition) (Wiley-Interscience, 1989) are preferable. Sulfur compounds are more preferable because they have high chain-transfer ability and because the required amount is small. Especially, hydrophobic mercaptane-based chain transfer agents, such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, and especially preferably 0.4 mass % to 1.6 mass %, based on the total amount of monomers.

Besides the foregoing compounds, in the emulsion polymerization, use can be made of additives, such as electrolytes, stabilizers, thickeners, defoaming agents, antioxidants, vulcanizers, antifreezing agents, gelling agents, and vulcanization accelerators, as described, for example, in Synthetic Rubber Handbook.

In the coating solution of the latex polymer to be used in the present invention, an aqueous solvent can be used as the solvent, and a water-miscible organic solvent may optionally be used in combination. Examples of the water-miscible organic solvent include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably 40 mass % or less of the entire solvent, more preferably 30 mass % or less of the entire solvent.

Furthermore, in the latex polymer for use in the present invention, the polymer concentration is, based on the amount of the latex liquid, preferably 10 mass % to 70 mass %, more preferably 20 mass % to 60 mass %, and especially preferably 30 mass % to 55 mass %.

The amount of the latex polymer to be added is preferably 50 to 95% by mass and more preferably 70 to 90% by mass as its solid content based on all polymers in the receptor layer.

The latex polymer in the image-receiving sheet according to the present invention includes a state of a gel or dried film formed by removing a part of solvents by drying after coating.

<Ultraviolet Absorber>

Also, in the present invention, in order to improve light resistance, an ultraviolet absorber may be added to the receptor layer. In this case, when this ultraviolet absorber is made to have a higher molecular mass, it can be secured to the receptor layer so that it can be prevented, for instance, from being diffused into the ink sheet and from being sublimated and vaporized by heating.

As the ultraviolet absorber, compounds having various ultraviolet absorber skeletons, which are widely known in the field of information recording, may be used. Specific examples of the ultraviolet absorber may include compounds having a 2-hydroxybenzotriazole-type ultraviolet absorber skeleton, 2-hydroxybenzotriazine-type ultraviolet absorber skeleton, or 2-hydroxybenzophenon-type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular mass and using in a form of a latex. Specifically, ultraviolet absorbers described in, for example, JP-A-2004-361936 may be used.

The ultraviolet absorber preferably absorbs light at wavelengths in the ultraviolet region, and the absorption edge of the absorption of the ultraviolet absorber is preferably out of the visible region. Specifically, when it is added to the receptor layer to form a heat-sensitive transfer image-receiving sheet, the heat-sensitive transfer image-receiving sheet has a reflection density of, preferably, Abs 0.5 or more at 370 nm, and more preferably Abs 0.5 or more at 380 nm. Also, the heat-sensitive transfer image-receiving sheet has a reflection density of, preferably, Abs 0.1 or less at 400 nm. If the reflection density at a wavelength range exceeding 400 nm is high, it is not preferable because an image is made yellowish.

In the present invention, the ultraviolet absorber is preferably made to have a higher molecular mass. The ultraviolet absorber has a mass average molecular mass of preferably 10,000 or more, and more preferably 100,000 or more. As a means of obtaining a higher-molecular mass ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass, more preferably 8 to 15% by mass.

Furthermore, it is more preferable that the ultraviolet-absorber-grafted polymer is made to be used in a form of a latex. When the polymer is made to be used in a form of a latex, an aqueous dispersion-system coating solution may be used in application and coating to form the receptor layer, and this enables reduction of production cost. As a method of making the latex polymer (or making the polymer latex-wise), a method described in, for example, Japanese Patent No. 3450339, may be used. As the ultraviolet absorber to be used in a form of a latex, the following commercially available ultraviolet absorbers may be used, which include ULS-700, ULS-1700, ULS-1383MA, ULS-1635MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of making an ultraviolet-absorber-grafted polymer into a form of a latex, it may be mixed with a latex of the receptor polymer capable of being dyed, and the resultant mixture is to be used for coating. By doing so, a receptor layer, in which the ultraviolet absorber is homogeneously dispersed, can be formed.

The addition amount of the ultraviolet-absorber-grafted polymer or its latex is preferably 5 to 50 parts by mass, more preferably 10 to 30 parts by mass, to 100 parts by mass of the latex of the receptor polymer capable of being dyed, which receptor polymer is to be utilized to form the receptor layer.

<Releasing Agent>

Also, a releasing agent may be compounded in the receptor layer, in order to prevent thermal fusion with the heat-sensitive transfer sheet when an image is formed. As the releasing agent, a silicone oil, a phosphate-based plasticizer, or a fluorine-series compound may be used, and the silicone oil is particularly preferably used. As the silicone oil, modified silicone oil, such as epoxy-modified, alkyl-modified, amino-modified, carboxyl-modified, alcohol-modified, fluorine-modified, alkyl aralkyl polyether-modified, epoxy/polyether-modified, or polyether-modified silicone oil, is preferably used. Among these, a reaction product between vinyl-modified silicone oil and hydrogen-modified silicone oil is preferable. The amount of the releasing agent is preferably 0.2 to 30 parts by mass, per 100 parts by mass of the receptor polymer.

The lubricants described in the following paragraph "Emulsion" are recognized to be of almost the same effects as the releasing agents described herein. In the present invention, for convenience sake, ingredients used in a state of dispersion are classified as lubricant emulsions, and others as release agents described herein.

<Emulsion>

Hydrophobic additives, such as a lubricant, an antioxidant, and the like, can be introduced into a layer of the image-receiving sheet (e.g. the receptor layer, the heat insulation layer, the undercoat layer), by using a known method described in U.S. Pat. No. 2,322,027, or the like. In this case, a high-boiling organic solvent, as described in U.S. Pat. No. 4,555,470, No. 4,536,466, No. 4,536,467, No. 4,587,206, No. 4,555,476 and No. 4,599,296, JP-B-3-62256, and the like, may be used singly or in combination with a low-boiling organic solvent having a boiling point of 50 to 160° C., according to the need. Also, these lubricants, antioxidants, and high-boiling organic solvents may be respectively used in combination of two or more of those.

As the lubricant, solid waxes such as polyethylene wax, amide wax and Teflon (registered trademark) powder; silicone oil, phosphate-series compounds, fluorine-based surfactants, silicone-based surfactants and others including releasing agents known in the technical fields concerned may be used. Various waxes, fluorine-series compounds typified by fluorine-based surfactants, silicone-based surfactants and silicone-series compounds such as silicone oil and/or its hardened products are preferably used.

<Matting Agent>

In the present invention, a matting agent is preferably contained for providing releasing property with the image-receiving sheet. The matting agent is preferably added to the outermost layer or the layer that functions as the outermost layer or a layer close to the outermost layer of the heat-sensitive transfer image-receiving sheet. The outermost layer may be composed of two layers, if necessary. Most preferably, the matting agent is added to the receptor layer disposed as the outermost layer. The matting agent may be added to the outermost layer on the same side as the image-forming side and/or the outermost layer at the back side. In the present invention, it is especially preferred that the matting agent is contained on the same side as the layer containing a sliding agent with respect to the support.

In the present invention, it is preferred that a matting agent is previously dispersed with a binder so that the matting agent can be used as a dispersion of matting agent particles.

In the present invention, examples of the matting agent generally include fine particles of water-insoluble organic compounds and fine particles of water-insoluble inorganic compounds. In the present invention, organic compound-containing fine particles are used from the viewpoints of dispersion properties. In so far as an organic compound is incorporated in the particles, there may be organic compound particles consisting of the organic compound alone, or alternatively organic/inorganic composite particles containing not only the organic compound but also an inorganic compound. As the matting agent, there can be used those materials well known in the field of silver halide photosensitive materials, such as organic matting agents described in, for example, U.S. Pat. No. 1,939,213, No. 2,701,245, No. 2,322,037, No. 3,262,782, No. 3,539,344, and No. 3,767,448.

It is preferred that the matting agent has a heat resistance because a surface temperature of the receptor layer becomes high at the time of graphic printing.

In the present invention, a preferable matting agent is composed of the polymer, in which the polymer has a thermal decomposition temperature of 200° C. or more, more preferably 240° C. or more. Besides, a hard matting agent is preferred because not only heat but also pressure is applied to the surface of the receptor layer at the time of graphic printing.

It is preferred that the matting agent preferably contained in the outermost layer and/or a layer adjacent to the outermost layer on the same side as an image-forming layer is previously dispersed with a binder and used as a dispersion of matting agent particles. As the method for dispersion, there are two methods, namely (a) a method of preparing dispersions of the matting agent, comprising the steps of preparing a solution of a polymer to be as a matting agent (for example, dissolving the polymer in a low boiling-point solvent), emulsifying and dispersing the solution in an aqueous medium to obtain droplets of the polymer, and then eliminating the low boiling-point solvent from the resultant emulsion, and (b) a method of preparing of dispersions, comprising the steps of previously preparing fine particles, including a polymer, to be as a matting agent, and then dispersing the fine particles in an aqueous medium while preventing from generation of aggregate. In the present invention, preferred is the method (b) that does not discharge such a low boiling-point solvent to environments from the environmental concern.

To the dispersions of the matting agent in the present invention, a surfactant is preferably added for stabilization of the dispersed state.

<Surfactant>

In the heat-sensitive transfer image-receiving sheet of the present invention, a surfactant may be contained in any of such layers as described above. Of these layers, it is preferable to contain the surfactant in the receptor layer and the intermediate layer.

An addition amount of the surfactant is preferably from 0.01% by mass to 5% by mass, more preferably from 0.01% by mass to 1% by mass, and especially preferably from 0.02% by mass to 0.2% by mass, based on the total solid content.

With respect to the surfactant, various kinds of surfactants such as anionic, nonionic and cationic surfactants are known. As the surfactant that can be used in the present invention, any known surfactants may be used. For example, it is possible to use surfactants as reviewed in "Kinosei kaimenkasseizai (Functional Surfactants)", editorial supervision of Mitsuo Tsunoda, edition on August in 2000, Chapter 6. Of these surfactants, fluorine-containing anionic surfactants are preferred.

Without any surfactant, a coating operation is possible. However, because surface tension of a coating solution is high, a coated surface state sometimes becomes lack of uniformity, which results in unevenness. By containing a surfactant to a coating solution, surface tension of the coating solution reduces. Thereby unevenness at the time of coating is eliminated and a coated surface state is made uniform. Consequently, a coating operation can be performed stably.

Specific examples of the fluorine compounds are set forth below. However, the fluorine compounds that can be used in the present invention are not by any means limited to the following examples. Herein, an alkyl group and a perfluoroalkyl group each means a group having a straight chain structure, unless otherwise indicated in their descriptive structures of the following exemplified compounds.

BFS-1

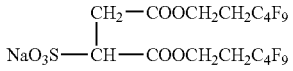

BFS-2

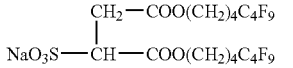

BFS-3

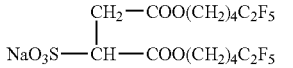

BFS-4

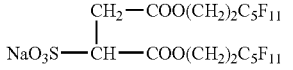

BFS-5

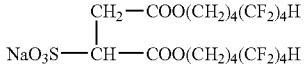

BFS-6

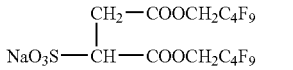

BFS-7

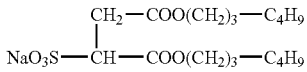

BFS-8

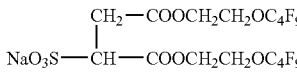

BFS-9

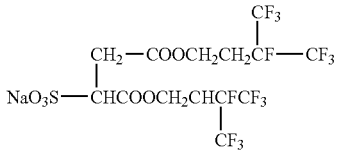

BFS-10

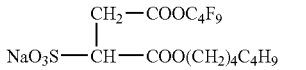

BFS-11

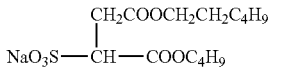

-continued

BFS-12

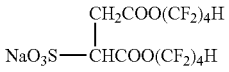

BFS-13

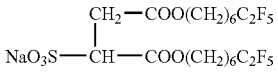

BFS-14

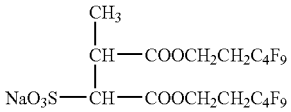

BFS-15

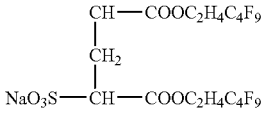

These fluorine compounds are used as a surfactant in a coating composition for forming layers (especially, a receptor layer, a heat-insulation layer, a protective layer, a subbing layer, a back layer, etc.) constituting the heat-sensitive transfer image-receiving sheet. In the present invention, they are preferably contained in the receptor layer and the intermediate layer.

<Antiseptics>

When coating solutions, an image-receiving sheet, a print image and the like are reserved, microorganism (especially, bacteria, mold, yeast, etc.) attaches to these materials during reservation, thereby to degrade their properties in many cases. In order to prevent from degradation in the properties, antiseptics may be contained in the coating solutions and the like.

The term "antiseptics" used herein is a compound that is used to prevent a compound for use in the image-receiving sheet from being subjected to decomposition reaction caused by growth of microorganism. Representation by formula and specific compounds are described in, for example, "Boufu Boukabi Handobukku (Hand book of antiseptic treatment and fungusproofing)", Gihoudo Shuppan (1986), "Boukin Boukabi no Kagaku (Chemistry of bacteria resistance and fungusproofing)", authored by Hiroshi Horiguchi, Sankyo Shuppan (1986), and "Boukin Boukabizai Jiten (Encyclopedia of bacteria resisting agents and fungusproofing agents)", published by Nippon Boukin Boukabi Gakkai (1986).

The antiseptics that can be contained in the image-receiving sheet of the present invention are not particularly limited. Examples of the antiseptics include phenol or its derivatives, formalin, imidazole derivatives, sodium dehydroacetate, 4-isothiazoline-3-on derivatives, benzoisothiazoline-3-on, benzotriazole derivatives, amidineguanidine derivatives, quaternary ammonium salts, pyrrolidine, quinoline, guanidine derivatives, diazine, triazole derivatives, oxazole, oxazine derivatives, 2-mercaptopyridine-N-oxide or its salt, and formaldehyde donor-series antibacterial agent. Of these antiseptics, materials such as phenol or its derivatives, 4-isothiazoline-3-on derivatives, and benzoisothiazoline-3-on are preferred.

Beside, compounds represented by any one of formulae (I) to (IV) set forth below can be used as the antiseptics.

Formula (I)

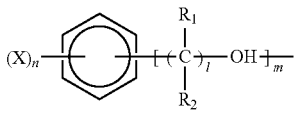

In formula (I), $R_1$ and $R_2$, which may be the same or different from each other, each represent a hydrogen atom, a hydroxyl group, or a lower alkyl group. X represents a hydrogen atom, a halogen atom, a nitro group, a cyano group, an aryl group, a lower alkyl group, a lower alkenyl group, an aralkyl group, an alkoxy group, —$COR_3$, —$SO_2R_4$, or —$N(R_5)R_6$. $R_3$ and $R_4$ each represent a hydrogen atom, —OM, a lower alkyl group, a lower alkoxy group, or —$N(R_7)R_8$. $R_5$ and $R_6$, which may be the same or different from each other, each represents a hydrogen atom, a lower alkyl group, —$COR_9$, or —$SO_2R_{10}$. $R_9$ and $R_{10}$ each represent a lower alkyl group, or —$N(R_{11})R_{12}$. $R_7$ and $R_8$, and $R_{11}$ and $R_{12}$, which may be the same or different from each other, each independently represents a hydrogen atom, or a lower alkyl group. M represents a hydrogen atom, an alkali metal atom, or atoms necessary for forming a univalent cation. 1 represents an integer of from 2 to 6. m represents an integer of from 1 to 4. n represents an integer of (6-m). When a plurality of $R_1$, $R_2$, or X is present, they may be different from each other, respectively.

Formula (II)

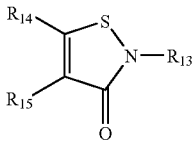

In formula (II), $R_{13}$ represents a hydrogen atom, an alkyl group, an alkenyl group, an aralkyl group, an aryl group, a heterocyclic group or the following group.

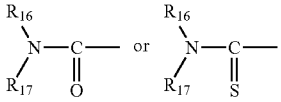

$R_{14}$ and $R_{15}$ each represent a hydrogen atom, a halogen atom, an alkyl group, an aryl group, a cyano group, a heterocyclic group, an alkylthio group, an alkylsulfoxy group, or an alkylsulfonyl group. $R_{14}$ and $R_{15}$ may bond together to form an aromatic ring. $R_{16}$ and $R_{17}$ each represent a hydrogen atom, an alkyl group, an aryl group, or an aralkyl group.

Of these compounds represented by formula (II), preferred is the compound in which $R_{14}$ and $R_{15}$ are each a hydrogen atom and $R_{13}$ is a methyl group. Hereinafter, said specific compound is designated as Compound II-a. It is more preferred to combine the Compound II-a and the compound in which $R_{14}$ and $R_{15}$ bond together to form an aromatic ring and $R_{13}$ is a hydrogen atom, or alternatively to combine the Com pound II-a and the compound in which $R_{14}$ is a chlorine atom, $R_{15}$ is a hydrogen atom and $R_{13}$ is a methyl group.

Formula (III)

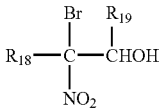

In formula (III), $R_{18}$ represents a hydrogen atom, an alkyl group or a hydroxymethyl group; and $R_{19}$ represents a hydrogen atom or an alkyl group.

Formula (IV)

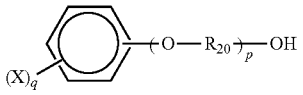

In formula (IV), $R_{20}$ represents a lower alkyl group. X represents a hydrogen atom, a halogen atom, a nitro atom, a hydroxyl group, a cyano group, a lower alkyl group, a lower alkoxy group, —$COR_{21}$ , —$N(R_{22})R_{23}$, or —$SO_3M$. $R_{21}$ represents a hydrogen atom, —OM, a lower alkyl group, an aryl group, an aralkyl group, a lower alkoxy group, an aryloxy group, an aralkyloxy group, or —$N(R_{24})R_{25}$. $R_{22}$ and $R_{23}$, which may be the same or different from each other, each represent a hydrogen atom, a lower alkyl group, an aryl group, an aralkyl group, —$COR_{26}$, or —$SO_2R_{26}$. $R_{24}$ and $R_{25}$, which may be the same or different from each other each represent a hydrogen atom, a lower alkyl group, an aryl group, or an aralkyl group. $R_{26}$ represents a lower alkyl group, an aryl group, or an aralkyl group. M represents a hydrogen atom, an alkali metal atom, or atoms necessary for forming a univalent cation. p represents 0 or 1. q represents 0 or an integer of from 1 to 5.

As the antiseptics, one kind material may be used alone. Alternatively, two or more kinds of arbitrary materials may be used in combination. The antiseptics may be added as it is, or may be added as a solution of the antiseptics dissolved in water or an organic solvent such as methanol, ethanol, isopropyl alcohol, acetone, ethylene, and ethylene glycol, to a coating solution for the image-receiving sheet. Alternatively, the antiseptics may be added to latex. Beside, after dissolving antiseptics in a high boiling solvent or a low boiling solvent, or a mixture thereof, followed by emulsion dispersion in the presence of a surfactant, the resultant dispersion of the antiseptics may be added to latex.

The amount of the receptor layer to be applied is preferably 0.5 to 10 g/$m^2$ (solid basis, hereinafter, the amount to be applied in the present specification means a value on solid basis, unless otherwise specified). The film thickness of the receptor layer is preferably 1 to 20 μm.

(Heat Insulation Layer)

A heat insulation layer (porous layer) serves to protect the support from heat when a thermal head or the like is used to carry out a transfer operation under heating. Also, because the heat insulation layer generally has proper cushion characteristics, a heat-sensitive transfer image-receiving sheet having high printing sensitivity can be obtained even in the case of using paper as a support.

In the image-receiving sheet of the present invention, the heat insulation layer contains hollow polymer particles.

The hollow polymer particles in the present invention are polymer particles having independent pores inside of the particles. The hollow polymer particles are preferably latex polymer particles. Examples of the hollow polymer particles include (1) non-foaming type hollow particles obtained in the following manner: water is contained inside of a capsule wall formed of a polystyrene, acryl resin, or styrene/acryl resin, and, after a coating solution is applied and dried, the water in the particles is vaporized out of the particles, with the result that the inside of each particle forms a hollow; (2) foaming type microballoons obtained in the following manner: a low-boiling point liquid, such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling point liquid inside of the particles, whereby the inside of each particle is made to be hollow; and (3) microballoons obtained by foaming the above (2) under heating in advance, to make hollow polymer particles.

The average particle diameter (particle size) of the hollow polymer particles is preferably 0.1 to 5.0 μm, more preferably 0.2 to 3.0 μm, and particularly preferably 0.3 to 1.0 μm. If the particle size is too small, the resultant particles tend to have a smaller hollow ratio, which may cause it impossible to obtain a desired heat-insulation property; whereas, if the particle size is too large, frequencies of surface defects generated due to causes other than the bulky particles in the heat insulation layer can increase.

The hollow ratio (percentage of hollowness) of the hollow polymer particles is preferably in the range of from about 20% to about 70%, and particularly preferably from 20% to 50%. If the hollow ratio is too small, it becomes difficult to obtain sufficient heat-insulating property. In contrast, if the hollow ratio is excessively higher, a proportion (rate) of hollow polymer particles which are easily broken and incomplete hollow particles increases in the aforementioned preferable range of the particle size, so that it causes printing defects and it becomes difficult to obtain sufficient film strength.

Such hollow polymer particles may be used in combinations of two or more. Specific examples of the above (1) include Rohpake 1055, manufactured by Rohm and Haas Co.; Boncoat PP-1000, manufactured by Dainippon Ink and Chemicals, Incorporated; SX866(B), manufactured by J S R Corporation; and Nippol MH5055, manufactured by Nippon Zeon (all of these product names are trade names). Specific examples of the above (2) include F-30, and F-50, manufactured by Matsumoto Yushi-Seiyaku Co., Ltd. (all of these product names are trade names). Specific examples of the above (3) include F-30E, manufactured by Matsumoto Yushi-Seiyaku Co., Ltd, and Expancel 461DE, 551DE, and 551DE20, manufactured by Nippon Ferrite (all of these product names are trade names). The hollow polymer particles for use in the heat insulation layer may be a latex thereof.

The hollow polymer particles used in the present invention are preferably non-foaming type hollow polymer particles. Among these, hollow polymer particles having glass transition temperature at least 10° C. higher than those of the latex polymers described above. When hollow polymer particles have low glass transition temperature, the particles cannot have sufficient porosity after undergoing coating and drying processes. More specifically, hollow polymer particles having glass transition temperatures of 90° C. or more are further preferred, and those having glass transition temperatures of 110° C. or more (preferably 200° C. or less) are especially preferred.

In point of effects of the present invention, it is preferable that the glass transition temperature relation between at least one of the hollow polymer particles (glass transition temperature: Tg2) and at least one dye-receiving latex polymer (glass transition temperature: Tg1) contained in the receptor layer satisfies the expression (Tg1+10)≦Tg2.

In the heat insulation layer containing the hollow polymer particles, a water-dispersible-type resin or water-soluble-type resin, in addition to the hollow polymer particles, is preferably added, as a binder (binder resin). As the binder resin that can be used in the present invention, use may be made of a known resin, such as an acryl resin, a styrene/acryl copolymer, a polystyrene resin, a polyvinyl alcohol resin, a vinyl acetate resin, an ethylene/vinyl acetate copolymer, a vinyl chloride/vinyl acetate copolymer, a styrene/butadiene copolymer, a urethane resin, a polyvinylidene chloride resin, a cellulose derivative, casein, starch, and gelatin. These are preferably a water-soluble polymer as described for the receptor layer. Among these binder resins, gelatin, a polyvinyl alcohol resin, a styrene/butadiene copolymer and a urethane resin are preferable; and gelatin and a polyvinyl alcohol resin are more preferable. Also, these resins may be used either singly or as a mixture thereof.

The solid content of the hollow polymer particles in the heat insulation layer preferably falls in a range from 5 to 2,000 parts by mass, assuming that the solid content of the binder resin be 100 parts by mass. Also, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, posing problems, for example, powder fall or film separation.

The amount of the binder in the coating solution for the heat insulation layer is preferably 0.5 to 14% by mass, and particularly preferably 1 to 6% by mass. Also, the coating amount of the above hollow polymer particles in the heat insulation layer is preferably 1 to 100 g/m$^2$, and more preferably 5 to 20 g/m$^2$.

A thickness of the heat insulation layer containing the hollow polymer particles is preferably from 5 to 50 μm, more preferably from 5 to 40 μm.

(Intermediate Layer)

An intermediate layer may be formed between support and the heat insulation layer. As the intermediate layer, for example, a white background controlling layer, a charge-controlling layer, an adhesive layer, a primer layer and/or an undercoat layer are formed. These layers may be formed in the same manner as those described in, for example, each specification of Japanese Patent Nos. 3585599 and 2925244.

(Support)

In the present invention, it is preferred to use a water-proof support as the support. The use of the waterproof support makes it possible to prevent the support from absorbing moisture, whereby a fluctuation in the performance of the receptor layer with the lapse of time can be prevented. As the waterproof support, for example, coated paper or laminate paper may be used. Especially, laminate paper is preferred in terms of surface smoothness. It is preferable to use a similar article to a polyethylene laminate paper (this paper is sometimes abbreviated as a WP paper) that is used for a photographic printing paper in the field of silver salt photography, namely a paper composed of cellulose as a main component in which at least one surface of said paper at the same side as the receptor layer-coating side is laminated with a polyolefin resin.

-Coated Paper-

The coated paper is paper obtained by coating a sheet, such as base paper, with any of various resins, rubber latexes, or high-molecular materials, on one side or both sides of the sheet, in which the coating amount differs depending on its use. Examples of such coated paper include art paper, cast coated paper, and Yankee paper.

It is preferable to use a thermoplastic resin as the resin to be applied to the surface(s) of the base paper and the like. As such a thermoplastic resin, the following thermoplastic resins (A) to (H) may be exemplified.

(A) Polyolefin resins, such as polyethylene resin and polypropylene resin; copolymer resins composed of an olefin, such as ethylene or propylene, and another vinyl monomer; and acrylic resins.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins, such as polymethyl methacrylate, polybutyl methacrylate, polymethyl acrylate, polybutyl acrylate, or the like; polycarbonate resins, polyvinyl acetate resins, styrene acrylate resins, styrene/methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-1 30 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220, and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins, such as polyvinyl butyral; and cellulose resins, such as ethyl cellulose resin and cellulose acetate resin.

(H) Polycaprolactone resins, styrene/maleic anhydride resins, polyacrylonitrile resins, polyether resins, epoxy resins, and phenolic resins.

The thermoplastic resins may be used either singly or in combination of two or more of those.

The thermoplastic resin may contain or may have contained a whitener, a conductive agent, a filler, a pigment or dye including, for example, titanium oxide, ultramarine blue, and carbon black; or the like, if necessary.

-Laminated Paper-

The laminated paper is a paper which is formed by laminating any of various kinds of resins, rubbers, polymer sheets or films, on a sheet, such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used either singly or in combination of two or more of those.

Generally, the polyolefins are prepared by using a low-density polyethylene, in many cases. In the present invention, however, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the lamination, it is particularly preferred to use the blend of a high-density polyethylene and a low-density polyethylene.

The blend of a high-density polyethylene and a low-density polyethylene is used in a blend ratio (a mass ratio) of generally 1/9 to 9/1, preferably 2/8 to 8/2, and more preferably 3/7 to 7/3. When the thermoplastic resin layer is formed on each surface of the support, the back side of the support is preferably formed using, for example, the high-density polyethylene, or the blend of a high-density polyethylene and a low-density polyethylene. The molecular mass of the polyethylenes is not particularly limited. Preferably, the high-density polyethylene and the low-density polyethylene each have a melt index of 1.0 to 40 g/10-min and a high extrudability.

The sheet or film may be subjected to a treatment to impart white reflection thereto. As a method of such a treatment, for example, a method of incorporating a pigment, such as titanium oxide, into the sheet or film, can be mentioned. The thus-processed paper is generally used as a support for a photographic printing paper in the field of silver salt photography. This paper is sometimes abbreviated as a WP paper.

The thickness of the support is preferably from 25 μm to 300 μm, more preferably from 50 μm to 260 μm, and further preferably from 75 μm to 220 μm. The support can have any rigidity according to the purpose. When it is used as a support for a heat-sensitive transfer image-receiving sheet of photographic image quality, the rigidity thereof is preferably near to that in a support for use in color silver halide photography.

(Curling-Control Layer)

When the support is exposed as it is, there is the case where the heat-sensitive transfer image-receiving sheet is made to curl by moisture and/or temperature in the environment. It is therefore preferable to form a curling-control layer on the backside of the support. The curling-control layer not only prevents the image-receiving sheet from curling but also has a water-proof function. For the curling-control layer, a polyethylene laminate, a polypropylene laminate, or the like is used. Specifically, the curling-control layer may be formed in a manner similar to those described in, for example, JP-A-61-110135 and JP-A-6-202295.

(Writing Layer and Charge-Controlling Layer)

For the writing layer and the charge-control layer, an inorganic oxide colloid, an ionic polymer, or the like may be used. As the antistatic agent, use may be made of any antistatic agents including cationic antistatic agents, such as a quaternary ammonium salt and polyamine derivative, anionic antistatic agents, such as alkyl phosphate, and nonionic antistatic agents, such as fatty acid ester. Specifically, the writing layer and the charge-control layer may be formed in a manner similar to those described in the specification of Japanese Patent No. 3585585.

The plural layers in the present invention are structured using resins as its major components. The resins forming each layer are preferably latex polymers. The solid content by mass of the resin put in a latex state in each layer coating solution is preferably in the range from 5 to 80% and particularly preferably 20 to 60%. The average particle size of the resin contained in the above latex polymer is preferably 5 μm or less and particularly preferably 1 μm or less. The above latex polymer may contain a known additive, such as a surfactant, a dispersant, and a binder resin, according to the need.

The heat-sensitive transfer image-receiving sheet of the present invention can suppress changes in maximum transfer density under high- or low-humidity conditions which have so far been caused in a heat-sensitive transfer image-receiving sheet produced by aqueous coating solutions. Moreover, the heat-sensitive transfer image-receiving sheet of the present invention can avoid occurrence of peel-off lines.

The present invention will be described in more detail based on the following examples, but the invention is not intended to be limited thereto. In the following examples, the terms "part(s)" and "%" are values by mass, unless otherwise specified.

EXAMPLES

Example 1

(Preparation of Ink Sheet)

A polyester film 4.5 μm in thickness (trade name: Lumirror, manufactured by Toray Industries, Inc.) was used as the substrate film. A heat-resistant slip layer (thickness: 1 μm) was formed on the back side of the film, and the following yellow, magenta, and cyan compositions were respectively applied as a monochromatic layer (coating amount: 1 g/m$^2$ after drying) on the front side of the film. Specifically, the yellow composition was applied on the polyester film, to form a yellow dye layer (region). Next, the magenta composition was applied next to the yellow dye region in the longitudinal direction of the polyester film, to form a magenta dye layer (region). Further, the cyan composition was applied next to the magenta dye region in the longitudinal direction of the polyester film, to form a cyan dye layer (region).

| Yellow composition | |
|---|---|
| Yellow dye (trade name: Macrolex Yellow 6G, manufactured by Bayer) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Magenta composition** | |
| Magenta dye (trade name; Disperse Red 60) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Cyan composition** | |
| Cyan dye (trade name: Solvent Blue 63) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

(Preparation of Protective Layer Sheet)

On the same polyester film as used for the preparation of the ink sheet, were coated a protective layer and an adhesion layer each having the composition set forth below. Dry coating amounts of the protective layer and the adhesion layer were controlled to 1 g/m$^2$ and 0.7 g/m$^2$, respectively. After coating and drying of the protective layer, the adhesion layer was coated on the protective layer. The protective layer and the adhesion layer were provided next to the cyan dye region in the longitudinal direction of the polyester film, to form the protective layer sheet.

| Protective layer | |
|---|---|
| Acrylic resin (DIANAL BR-80 (trade name), manufactured by Mitsubishi Rayon) | 20 parts by mass |
| Methyl ethyl ketone/toluene (1/1, at mass ratio) | 80 parts by mass |
| Adhesion layer | |
| Polyester resin (Vylon 220 (trade name), manufactured by Toyobo Co., Ltd.) | 30 parts by mass |
| Methyl ethyl ketone/toluene (1/1, at mass ratio) | 70 parts by mass |

(Preparation of Image-Receiving Sheet)

(Preparation of Support)

A pulp slurry was prepared from 50 parts by mass of hardwood bleach kraft pulp (LBKP) of acacia origin and 50 parts by mass of hardwood bleach kraft pulp (LBKP) of aspen origin, by beating these pulps by means of a disk refiner until Canadian standard freeness reached to 300 ml.

Then, to the pulp slurry thus prepared were added, on a pulp basis, 1.3 mass % of cationically-modified starch (CAT0304L, trade name, manufactured by Nippon NSC), 0.15 mass % of anionic polyacrylamide (DA4104, trade name, manufactured by Seiko PMC Corporation), 0.29 mass % of an alkylketene dimer (SIZEPINE K, trade name, manufactured by Arakawa Chemical Industries, Ltd.), 0.29 mass % of epoxidated behenic acid amide, and 0.32 mass % of polyamide polyamine epichlorohydrin (ARAFIX 100, trade name, manufactured by Arakawa Chemical Industries, Ltd.), and thereafter 0.12 mass % of a defoaming agent was further added.

The thus-prepared pulp slurry was made into paper by use of a fourdrinier paper machine. In a process of drying in which the felt side of web was pressed against a drum dryer cylinder via a dryer canvas, the web thus formed was dried under the condition that the tensile strength of the dryer canvas was adjusted to 1.6 kg/cm. Then, each side of the raw paper thus made was coated with 1 g/m$^2$ of polyvinyl alcohol (KL-118, trade name, manufactured by Kuraray Co., Ltd.) with a size press, followed by drying and further subjecting to calendering treatment. The papermaking was performed so that the raw paper had a grammage (basis weight) of 157 g/m$^2$, and the raw paper (base paper) of thickness 160 μm was obtained.

The wire side (back side) of the base paper obtained was subjected to corona discharge treatment, and thereto a resin composition, in which a high-density polyethylene of MFR (which stands for a melt flow rate, and hereinafter has the same meaning) 16.0 g/10-min and density 0.96 g/cm$^3$ (containing 250 ppm of hydrotalcite (DHT-4A (trade name), manufactured by Kyowa Chemical Industry Co., Ltd.) and 200 ppm of a secondary oxidation inhibitor (tris(2,4-di-t-butylphenyl)phosphite, Irugaphos 168 (trade name), manufactured by Ciba Specialty Chemicals)) and a low-density polyethylene of MFR 4.0 g/10-min and density 0.93 g/cm$^3$ were mixed at a ratio of 75 to 25 by mass, was applied so as to have a thickness of 21 g/m$^2$, by means of a melt extruder, thereby forming a thermoplastic resin layer with a mat surface. (The side to which this thermoplastic resin layer was provided is hereinafter referred to as "back side"). The thermoplastic resin layer at the back side was further subjected to corona discharge treatment, and then coated with a dispersion prepared by dispersing into water a 1:2 mixture (by mass) of aluminum oxide (ALUMINASOL 100, trade name, manufactured by Nissan Chemical Industries, Ltd.) and silicon dioxide (SNOWTEX O, trade name, manufactured by Nissan Chemical Industries, Ltd.), as an antistatic agent, so that the coating would have a dry mass of 0.2 g/m$^2$. Then, the front surface (front side) of the base paper was subjected to corona discharge treatment, and then coated with a low-density polyethylene of MFR 4.0 g/10-min and density 0.93 g/m$^2$, containing 10 mass % of titanium oxide, by means of a melt extruder, so that the coating amount would be 27 g/m$^2$, thereby forming a thermoplastic resin layer with a specular surface.

(Preparation of Emulsified Dispersions A and B)

(Preparation of Emulsified Dispersion A)

An emulsified dispersion A was prepared in the following manner. A compound (EB-9) was dissolved in a mixture of 42 g of a high-boiling solvent (Solv-5) and 20 ml of ethyl acetate, and the resultant solution was emulsified and dispersed in 250 g of a 20-mass % aqueous gelatin solution containing 1 g of sodium dodecylbenzenesulfonate, by means of a high-speed stirring emulsifier (dissolver). Thereto, water was added, to prepare 380 g of the emulsified dispersion A.

The addition amount of the compound (EB-9) was adjusted so that the compound would be contained in an amount of 30 mol % in the emulsified dispersion A.

(EB-9)

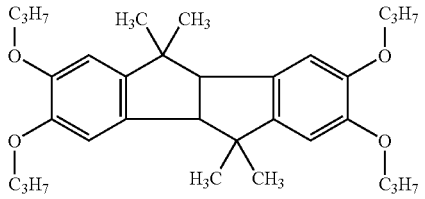

(Solv-5)

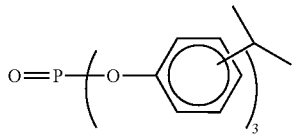

(Preparation of Emulsified Dispersion B)

An emulsified dispersion B was prepared in the following manner. Were dissolved 11.0 g of high boiling solvent (Solv-5), 9 g of KF-96 (dimethylsilicone, manufactured by Shinetsu Chemical), 15.5 g of (EB-9), 7.5 g of KAYARAD DPCA-30 (trade name, manufactured by Nippon Kayaku) in 20 ml of ethyl acetate, and the resultant solution was emulsified and dispersed in 250 g of a 20-mass % aqueous gelatin solution containing 1 g of sodium dodecylbenzenesulfonate, by means of a high-speed stirring emulsifier (dissolver). Thereto, water was added, to prepare 380 g of the emulsified dispersion B.

(Preparation of Heat-Sensitive Transfer Image-Receiving Sheet)

After corona discharge treatment was given to the surface of the thus made support, the resulting support underwent simultaneous multilayer coating of coating solutions for formation of a multilayer structure made up of the following undercoating layer 1, undercoating layer 2, heat insulation layer and receptor layer, which were stacked in the order presented. The simultaneous multi-layer coating was carried out, according to the slide coating method described above; and after coating, the thus-coated products were passed through a cooling zone at 8° C. for 35 seconds to lose fluidity, followed by drying by spraying a drying air at 22° C. and 45% RH on the coated surface for 2 minutes. The compositions and coated amounts of the coating solutions to be used are shown below.

| Coating solution for undercoating layer 1 (Composition) | |
|---|---|
| Aqueous solution, prepared by adding 1% of sodium dodecylbenzenesulfonate to a 3% aqueous gelatin solution | |
| NaOH for adjusting pH to 8 | |
| (Coating amount) | 11 ml/m$^2$ |

| Coating solution for undercoating layer 2 (Composition) | |
|---|---|
| Styrene-butadiene latex (SR103 (trade name), manufactured by Nippon A & L Inc.) | 60 parts by mass |
| 6% Aqueous solution of polyvinyl alcohol (PVA) | 40 parts by mass |
| Aqueous 1% surfactant solution (BFS-1) | 2 parts by mass |
| NaOH for adjusting pH to 8 | |
| (Coating amount) | 11 ml/m$^2$ |

| Coating solution for heat insulation layer (Composition) | |
|---|---|
| Emulsified dispersion A prepared in the above | 21 parts by mass |
| Aqueous dispersion of hollow polymer particles (MH5055 (trade name), manufactured by Nippon Zeon Corporation) | 48 parts by mass |
| 10% Gelatin aqueous solution | 28 parts by mass |
| Water | 3 parts by mass |
| Antiseptic (PR-1) (1,2-benzisothiazole-3(2H)-one) | 0.2 part by mass |
| NaOH for adjusting pH to 8.5 | |
| (Coating amount) | 50 ml/m$^2$ |
| (Viscosity of coating solution) | 45 cp |

| Coating solution for receptor layer (Composition) | |
|---|---|
| Emulsified dispersion B prepared in the above | 4 parts by mass |
| Aqueous solution of vinyl chloride/acrylic compound latex copolymer (VINYBLAN 900 (trade name), manufactured by Nissin Chemical Industry Co., Ltd.) | 53 parts by mass |
| Aqueous solution of vinyl chloride/acrylic compound latex copolymer (VINYBLAN 276 (trade name), manufactured by Nissin Chemical Industry Co., Ltd.) | 10 parts by mass |
| Microcrystalline wax dispersion (EMUSTAR-42X (trade name), manufactured by Nippon Seiro Co., Ltd.) | 6 parts by mass |
| Water | 22 parts by mass |
| Aqueous 1% surfactant solution (BFS-1) | 4 parts by mass |
| Matting agent (Melamine-silica resin (OPTBEADS 2000M (trade name) manufactured by Nissan Chemical Industries, Ltd.)) | 1 part by mass |
| Antiseptic (PR-1) | 0.1 part by mass |
| NaOH for adjusting pH to 6 | |

-continued

| | |
|---|---|
| (Coating amount) | 18 ml/m$^2$ |
| (Viscosity of coating solution) | 7 cp |

The above-obtained heat-sensitive transfer image-receiving sheet was processed, as follow.

Sample 101 (Comparative Example) was made into rolls having a length of 55 m as it was continuously cut to strips in 152 mm width.

Sample 102 was made into rolls having a length of 55 m as it was continuously cut to strips in 152 mm width, and then each roll was wrapped in a polystyrene sheet so that all its periphery including the cut surfaces was covered with the sheet.

Sample 103 was made into rolls having a length of 55 m as it was continuously cut to strips in 152 mm width, and then each roll was wrapped in a nylon-6 sheet so that all its periphery including the cut surfaces was covered with the sheet.

Sample 104 was made into rolls having a length of 55 m as it was continuously cut to strips in 152 mm width, and then each roll was wrapped in a polyethylene sheet so that all its periphery including the cut surfaces was covered with the sheet.

Sample 105 was made into rolls having a length of 55 m as it was continuously cut to strips in 152 mm width, and then each roll was wrapped in a polyvinylidene chloride sheet so that all its periphery including the cut surfaces was covered with the sheet.

Sample 106 was made into rolls having a length of 55 m as it was continuously cut to strips in 152 mm width, and then each roll was wrapped in a polypropylene sheet so that all its periphery including the cut surfaces was covered with the sheet.

Samples 101 to 106 were each stored for 7 days at a temperature of 30° C. under different humidity conditions of 30%, 55% and 80%, and then image formation (printing) on each individual image-receiving sheet was performed with the printer described hereinafter.

With respect to the protective sheets used in the above, the moisture permeability at a temperature of 25° C. and a relative humidity of 90% of each of the polystyrene sheet, the nylon-6 sheet, the polyethylene sheet, the polyvinylidene chloride sheet and the polypropylene sheet were 110 g/m$^2$·day, 270 g/m$^2$·day, 18 g/m2·day, 33 g/m$^2$·day and 8 g/m$^2$·day, respectively.

TABLE 1

| | | | | | Print Quality | |
|---|---|---|---|---|---|---|
| Sample No. | Processing method | Packaging | Medium Exchange | Transport Suitability | Change of maximum density | Peel-off line |
| 101 (Comparative example) | Rolling process 152 mm × 55 m | No package | Once (only the first) | Good | 2 | 2 |
| 102 | Rolling process 152 mm × 55 m | Polystyrene sheet package | Once (only the first) | Good | 3 | 2 |
| 103 | Rolling process 152 mm × 55 m | Nylon-6 sheet package | Once (only the first) | Good | 3 | 2 |
| 104 | Rolling process 152 mm × 55 m | Polyethylene sheet package | Once (only the first) | Good | 5 | 5 |
| 105 | Rolling process 152 mm × 55 m | Polyvinylidene chloride sheet package | Once (only the first) | Good | 5 | 5 |
| 106 | Rolling process 152 mm × 55 m | Polypropylene sheet package | Once (only the first) | Good | 5 | 5 |

(Image Formation)

The ink sheet and any of the heat-sensitive transfer image-receiving sheets 101 to 106 were each worked so as to become loadable, and a printed output was produced on each combination of the ink sheet and any of the image-receiving sheets, in a high-speed print mode, by use of a sublimation-type thermal transfer printer ASK2000 (trade name, manufactured by FUJIFILM Corporation). Herein, the time interval between ejection of one printed piece and ejection of the next one was 8 seconds.

(Performance Evaluation)

For evaluation of image defects, output of gray-scale images from white to maximum gray (solid black) was produced on 3 sheets of each sample. Changes in the maximum density as print quality were evaluated as follows. Specifically, an average maximum density of the three sheets of each sample was determined. And the maximum density in printing after the storage at the humidity of 30% was symbolized as D30, that after the storage at the humidity of 55% as D55 and that after the storage at the humidity of 80% as D80. The changing rate of the maximum density was calculated by the following equation, and judged by the criteria described below.

Changing rate of maximum density=|D30-D80|/D55*100 (%)

Criteria

5: (Changing rate of maximum density) ≦5%

4: 5% <(Changing rate of maximum density) ≦10%

3: 10% <(Changing rate of maximum density) ≦15%

2: 15% <(Changing rate of maximum density) ≦20%

1: 20% <(Changing rate of maximum density)

For evaluation of peel-off lines, images with alternations between white and maximum-gray (solid black) areas were continuously produced on 50 sheets, and judged by the criteria described below.

Criteria

5: No peel-off line was observed, so there was no problem.

4: Faint peel-off lines were perceived by visual observation, but there was no problem from the practical point of view.

3: Peel-off lines were perceived by visual observation, and they became problems in some cases from the practical point of view.

2: Prints were ejected, but they had a serious image problem and were unable to withstand practical use.

1: Sometimes there occurred a problem that prints were not ejected.

As can be seen from Table 1, particularly, Samples 104 to 106 according to the present invention were not only small in changes of maximum transfer density but also free of peel-off lines to our surprise and delivered beautiful images in contrast to the samples as other examples.

Having described our invention as related to the present embodiments, it is our intention that the invention not be limited by any of the details of the description, unless otherwise specified, but rather be construed broadly within its spirit and scope as set out in the accompanying claims.

What we claim is:

1. A packaging containing a heat-sensitive transfer image-receiving sheet in the form of a roll, wherein the heat-sensitive transfer image-receiving sheet comprises, on a support, at least one receptor layer containing a latex polymer, and at least one heat-insulation layer containing hollow polymer particles, the packaging is formed by polyethylene or polyvinylidene chloride, and the packaging is in the form of a sack.

2. The packaging according to claim 1, wherein the packaging is moistureproof.

3. The packaging according to claim 1, wherein the permeability of the packaging at a temperature of 25° C. and a relative humidity of 90% is 100 g/m$^2$·day or less.

4. The packaging according to claim 1, wherein the heat-sensitive transfer image-receiving sheet contains a water-soluble polymer.

5. The packaging according to claim 1, wherein the heat-sensitive transfer image-receiving sheet is produced by a simultaneous multilayer coating.

6. The packaging according to claim 1, wherein the latex polymer in the receptor layer of the heat-sensitive transfer image-receiving sheet is any one selected from the group consisting of a vinyl chloride/acrylic compound latex copolymer, a vinyl chloride/vinyl acetate latex copolymer, a vinyl chloride/vinyl acetate-acrylic compound copolymer latex, and any combination of these.

7. The packaging according to claim 1, wherein the latex polymer in the receptor layer of the heat-sensitive transfer image-receiving sheet is a vinyl chloride/acrylic compound latex copolymer.

8. The packaging as claimed in claim 1, wherein the hollow polymer particles of the heat-insulation layer have an average particle diameter of 0.2 to 3.0 μm and are non-foaming type hollow particles formed of a polystyrene, an acryl resin, or a styrene/acryl resin.

9. The packaging as claimed in claim 1, wherein the hollow polymer particles of the heat-insulation layer comprise hollow polymer particles having a glass transition temperature higher than the glass transition temperature of the latex polymer in the receptor layer.

10. The packaging as claimed in claim 1, wherein the glass transition temperature of the hollow polymer particles of the heat-insulation layer is 90° C. or more.

11. The packaging as claimed in claim 1, wherein the heat-insulation layer contains a water-soluble polymer.

12. The packaging as claimed in claim 1, wherein the heat-insulation layer contains a gelatin.

13. The packaging as claimed in claim 1, wherein the hollow polymer particles and the water-soluble polymer are the only resins contained in the heat-insulation layer.

14. The packaging as claimed in claim 1, wherein the receptor layer contains a water-soluble polymer.

15. The packaging as claimed in claim 1, wherein the heat-sensitive transfer image-receiving sheet comprises an intermediate layer between the support and the heat-insulation layer.

16. The packaging as claimed in claim 1, wherein the heat-sensitive transfer image-receiving sheet further comprises a compound represented by formula (II):

Formula (II)

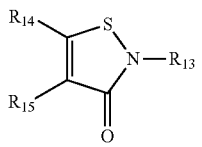

wherein $R_{13}$ represents a hydrogen atom, an alkyl group, an alkenyl group, an aralkyl group, an aryl group, a heterocyclic group or the following group:

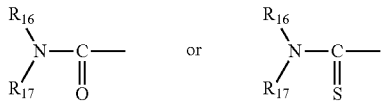

wherein $R_{14}$ and $R_{15}$ each represent a hydrogen atom, a halogen atom, an alkyl group, an aryl group, a cyano group, a heterocyclic group, an alkylthio group, an alkylsulfoxy group, or an alkylsulfonyl group; $R_{14}$ and $R_{15}$ may bond together to form an aromatic ring; $R_{16}$ and $R_{17}$ each represent a hydrogen atom, an alkyl group, an aryl group, or an aralkyl group.

17. The packaging as claimed in claim 1, wherein the heat-sensitive transfer image-receiving sheet further comprises a fluorine-containing anionic surfactant.

* * * * *